US005422635A

United States Patent [19]

Morishima

[11] Patent Number: 5,422,635

[45] Date of Patent: Jun. 6, 1995

[54] PAGING RECEIVER CAPABLE OF AVOIDING RAPID CONSUMPTION OF BATTERY POWER AND METHOD OF CONTROLLING THE SAME

[75] Inventor: Masaaki Morishima, Tokyo, Japan

[73] Assignee: NEC Corporation, Japan

[21] Appl. No.: 7,121

[22] Filed: Jan. 21, 1993

[30] Foreign Application Priority Data

Feb. 27, 1992 [JP] Japan ..... 4-076277

[51] Int. Cl.[6] ..... G08B 5/22

[52] U.S. Cl. ..... 340/825.440; 340/825.460

[58] Field of Search ..... 340/825.46, 825.44, 340/825.48, 811.1; 455/38.2; 379/56, 57

[56] References Cited

U.S. PATENT DOCUMENTS

| | | | |
|---|---|---|---|
| 4,755,816 | 7/1988 | DeLuca | 340/825.44 |
| 4,769,641 | 9/1988 | Yoshizawa et al. | 340/825.44 |
| 4,918,438 | 4/1990 | Yamasaki | 340/825.46 |

OTHER PUBLICATIONS

Mori, et al., "Information Display Pager" NEC Research & Development, No. 77, pp. 70–79, Apr. 1985.

*Primary Examiner*—Michael Horabik
*Assistant Examiner*—Edwin C. Holloway, III
*Attorney, Agent, or Firm*—Laff, Whitesel, Conte & Saret

[57] ABSTRACT

A paging receiver that reports to a person carrying the receiver responsive to the reception of paging calls, the report being made by driving at least one of a plurality of alerting devices. The alert is given when paging calls, including the page number of the receiver, are detected. When paging calls succeeding an initial paging call are received while the plurality of alerting devices are being driven to report the reception of the initial paging call, the receptions of the succeeding paging calls are stored. After the alert operation reporting the reception of the initial paging call is completed, only the one alerting device that consumes the least amount of power among the plurality of alerting devices, for example, an LED, is driven to report the receptions of the succeeding paging calls.

20 Claims, 2 Drawing Sheets

PAGING RECEIVER CAPABLE OF AVOIDING RAPID CONSUMPTION OF BATTERY POWER AND METHOD OF CONTROLLING THE SAME

BACKGROUND OF THE INVENTION

1. Field of the Invention

The present invention relates to a paging receiver, particularly to a paging receiver having a plurality of alert means.

2. Description of the Prior Art

Hitherto, when a paging receiver of this type detects a paging call including the call number of its receiver, the paging receiver reports to its carrier the reception of the paging call by driving a plurality of alert means, combining such alert means as an auditory alert means that sounds a buzzer, a tactile alert means that activates a vibrator (VIB), and a light-emitting visual alert means that activates a light-emitting diode (LED) or the like. In recent years, the receiver is provided with a liquid crystal display (LCD) so as to immediately relay messages to the carrier.

Such paging receivers are disclosed in "Information Display Pager" in NEC Research & Development No. 77, pp. 70–79, April 1985. The pager is equipped with an alert tone, an LED and an LCD. In addition, a paging receiver is disclosed in U.S. Pat. No. 4,918,438 (Apr. 17, 1990) which is equipped with a VIB drive unit and a loudspeaker drive unit, and these two alerts are activated sequentially in order to ensure that the carrier is alerted of the reception of paging calls. Hence, paging receivers equipped with LED and LCD in addition to a VIB or a loudspeaker are now in wide use.

Power consumption of paging receivers has increased with the provision of a plurality of alert means and message display means described above. Particularly, since a VIB has a motor drive and continuously consumes a large current from the battery, lengthy consecutive operation of the VIB may possibly deteriorate the battery life of the paging receiver, and further, anomalous operation of the paging receiver may possibly be caused when it is operated with a battery of reduced capacity. The duration of reporting of received calls is lengthy when approximately simultaneous calls from a plurality of callers are received, and in addition, when a receiver with message display means receives a long message from one caller that is divided and transmitted in several batches. For example, when a number n of succeeding calls including 1/n of one message each are received, a plurality of alert means are operated consecutively over n times the duration of the predetermined time period for reporting the reception of one paging call (for example, 20 seconds) if reporting is not stopped by the carrier. In the present invention, only one alert entailing minimum power consumption is activated for reporting the reception of succeeding paging calls.

SUMMARY OF THE INVENTION

An object of the present invention is to provide a paging receiver and a method of controlling the same so as to avoid useless shortening of battery life and erroneous operation due to rapid consumption of battery power by controlling the power consumption of the paging receiver.

To achieve the above object, there is provided a paging receiver comprising:

detection means for receiving and demodulating radio signals conveying paging calls and detecting a paging call designating the paging receiver;

memory means for storing the detection of the paging call;

a plurality of alert means for reporting the detection of the paging call to the carrier of the paging receiver;

stopping means for automatically and manually stopping reporting of the alert means;

control means for controlling the operations of the detection means, memory means, alert means, and stopping means, wherein more than one of the alert means are driven from the time that the paging call is initially detected and are driven either for the duration of a first predetermined time period or until the more than one alert means are manually stopped by the stopping means, and when a succeeding paging call is subsequently detected and the detection is stored in the memory means while the more than one alert means are being driven, only one of the alert means is driven from either the time that the first predetermined time period elapses or the time that the more than one alert means are manually stopped and the one alert means is driven either for the duration of a second predetermined time period or until the one alert means is manually stopped.

According to another aspect of this invention, there is provided a method of controlling a paging receiver comprising the steps of:

receiving and demodulating radio signals conveying paging calls and detecting a paging call designating the paging receiver, driving more than one alert means to report the initial detection of a paging call to the carrier of the paging receiver either for the duration of a first predetermined time period or until the more than one alert means are manually stopped, and when a succeeding paging call is detected and the detection is stored while the more than one alert means are being driven, driving only one of the alert means from either the time that the first predetermined time elapses or the time that the more than one alert means are manually stopped and driving the one alert means either for the duration of a second predetermined time period or until the one alert means is manually stopped.

DESCRIPTION OF THE PREFERRED EMBODIMENTS

Explanations of a paging receiver will be given below as a preferred embodiment of the present invention with reference to the attached drawings.

Figure 1:
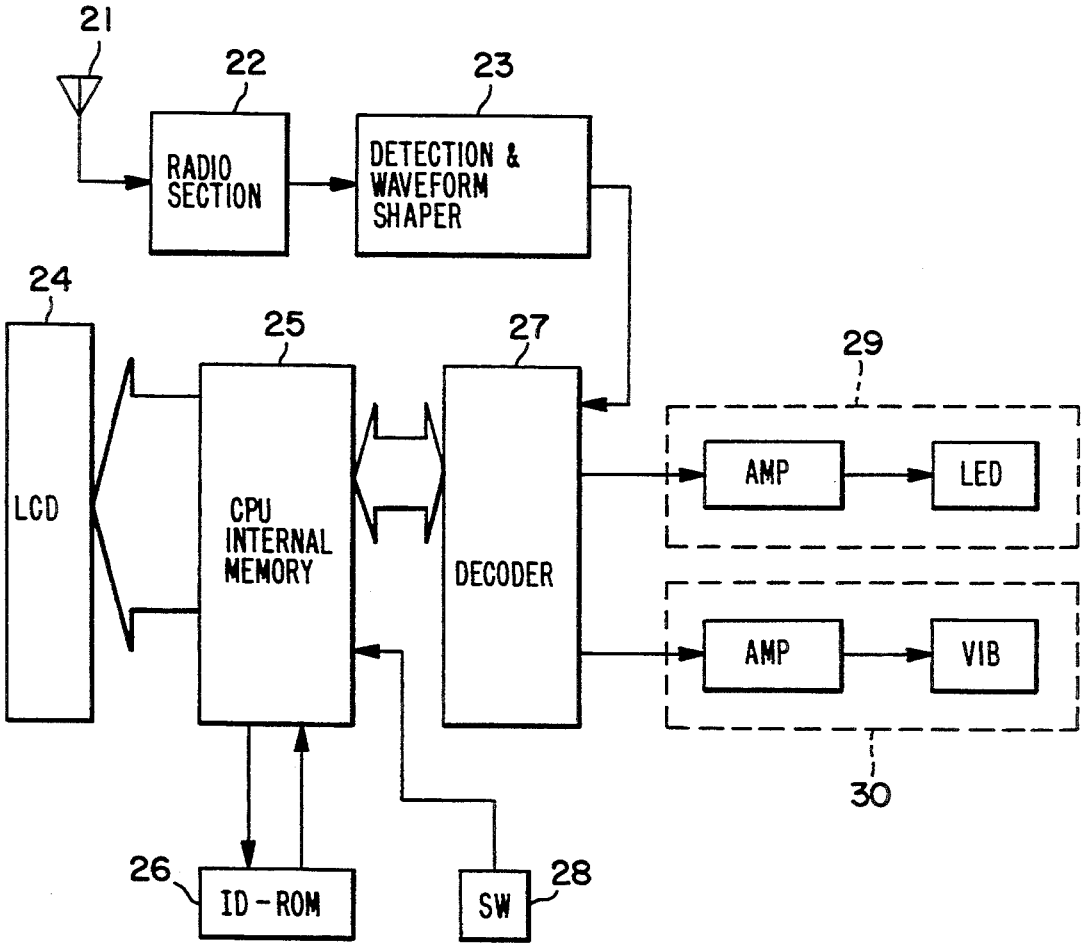
FIG. 1 is a block diagram showing the construction of an embodiment of the paging receiver according to the present invention.

The paging receiver shown in FIG. 1 comprises an antenna 21, a radio section 22, a detection and waveform-shaper 23 for demodulating the received radio signals, an LED drive unit 29 composed of an LED and an amplifier (AMP) for amplifying signals to be supplied to the LED, a VIB drive unit 30 composed of a vibrator (VIB) and an amplifier (AMP) for amplifying signals to be supplied to the VIB, an ID-ROM for storing the page number (ID-number) assigned to the paging receiver, a decoder 27 for comparing the ID-number stored in the ID-ROM 26 with the ID-number included in the demodulated paging information and sending control signals to either one or both of the LED drive unit 29 and VIB drive unit 30 when the above ID-numbers accord with each other, an LCD 24 for displaying messages included in the paging calls, a switch 28 for manually stopping the alert operation of the VIB drive unit 30 and LED drive unit 29, and a CPU 25 which contains memory and controls the operations of the various sections above.

When a paging call which includes the accorded ID-number is detected in the received radio signals, the detection of the paging call as well as the message included within the same paging call are stored in the internal memories in the CPU 25, and either one or both of the VIB drive unit 40 and LED drive unit 39 are driven so as to report to the carrier of the paging receiver the reception of the paging call sent to the receiver. At the same time the message is displayed on the LCD 24.

Figure 2:
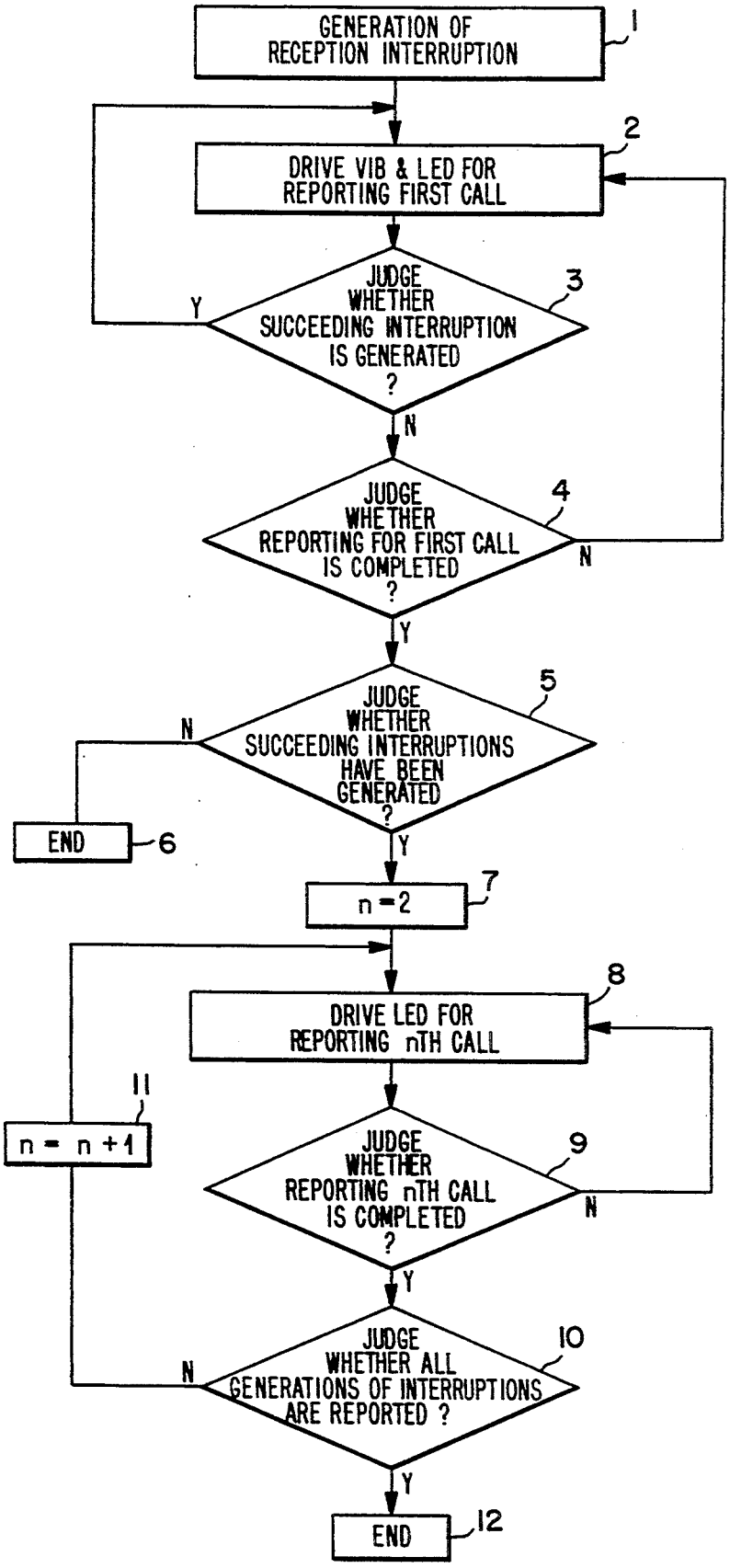
FIG. 2 is a flowchart showing the process of the alert operation of a VIB drive unit and LED drive unit of the paging receiver shown in FIG. 1.

FIG. 2 shows an example of the process of the alert operation of the VIB drive unit 30 and the LED drive unit 29.

When a first reception interruption is initially generated caused by the reception of a paging call that includes the ID-number of the receiver (step 1), the CPU 25 instructs the decoder 27 to drive both the VIB and LED to alert the carrier. On receiving the instructions from the CPU 25, the decoder 27 prepares control signals to drive the VIB drive unit 30 and the LED drive unit 29 (step 2). The CPU 25 performs time counting and monitoring of the alert operation from the time of generation of the above interruption (step 4) and continues to operate both drive units 29, 30 so as to report the reception of the first paging call until the reporting time is up (step 4). Here, "time up" includes a case in which the time is up when a predetermined time (e.g., 20 seconds) has elapsed (an automatic stop) and another case in which time is up when the carrier pushes the switch 28 before the predetermined time has elapsed (a manual stop). While continuing the operation of both drive units, the CPU 25 monitors whether another reception interruption (succeeding reception interruption) is generated (step 3). When a second generation is confirmed, the CPU 25 stores the generation of the interruption in an internal memory, drives both the VIB and LED alerts for the first paging call for the duration of the first predetermined time period and performs the time counting and monitoring. The operation is carried out in the same way as above when succeeding reception interruptions are generated while reporting the first paging call. When the time of reporting for the first paging call is up, the CPU 25 judges whether succeeding reception interruptions were generated while reporting for the first paging call was continuing (step 5). If no succeeding reception interruptions were generated, the CPU 25 instructs the VIB drive unit 30 and LED drive unit 29 to stop through the decoder 27 (step 6).

If it is found in step 5 that there was at least one generation of a succeeding reception interruption before the time of reporting for the first paging call was up, only the LED drive unit 29 is activated for reporting the reception of the second paging call (step 7–step 8). The CPU 25 performs time counting of reporting for the second paging call and monitors whether the LED alert is manually stopped (step 9), and after the time is up, it judges whether all generations of succeeding reception interruptions were reported or not (step 10). If there are any interruptions to report, the LED is driven to report the third and succeeding paging calls sequentially in the same way as above (step 10–step 11—step 8–step 9). When the reporting for all succeeding receiving interruptions is completed, operation of the LED drive unit 29 is stopped (step 12).

What is claimed is:

1. A paging receiver comprising:

detection means for receiving and demodulating radio signals conveying paging calls and for detecting a paging call designating said paging receiver;

memory means for storing the detection of said paging call;

a plurality of alert means for reporting the detection of said paging call to the carrier of said paging receiver;

stopping means for both automatically and manually stopping a reporting of said alert means;

control means for controlling the operations of said detection means, memory means, alert means and stopping means, said control means controlling said operations to cause a plurality of said alert means to be driven during a first predetermined time period beginning at the time when said paging call is initially detected by said detection means and the storage of the detection is in said memory means and continuing until either an end of said first predetermined time period or a time when said plurality of alert means are manually stopped by said stopping means, and when said detection means subsequently detects a succeeding paging call and storage of the subsequent detection is in said memory means while said plurality of alert means are being driven during said first predetermined time period, said control means controlling said operation to cause said plurality of alert means to be driven anew either for the duration of said first predetermined time period or until a time when said plurality of alert means are manually stopped, and thereafter to cause only one of said alert means to be driven during a second predetermined time period beginning either at the time when said first predetermined time period elapses or at the lime when said plurality of alert means are manually stopped and continuing until either an end of said second predetermined time period or a time when said only one of said alert means is manually stopped.

2. A paging receiver according to claim 1, wherein said second predetermined time period includes a plurality of prescribed time periods, each one of said prescribed time periods being assigned to each individual one of said succeeding paging calls and every detection of said succeeding paging calls being reported one by one in order either for the duration of the individually assigned time periods or until said only one of said alert means is manually stopped.

3. A paging receiver according to claim 2, herein a part or the whole of said first predetermined time period and each of said assigned time periods are equal.

4. A paging receiver according to claim 2, wherein said one alert means consumes the least power among said plurality of alert means.

5. A paging receiver according to claim 4, wherein said one alert means is a light-emitting diode.

6. A paging receiver according to claim 1, wherein a part or the entirety of said first predetermined time period and said assigned time periods are equal time periods.

7. A paging receiver according to claim 6, wherein said one alert means consumes the least power among said plurality of alert means.

8. A paging receiver according to claim 7, wherein said one alert means is a light-emitting diode.

9. A paging receiver according to claim 1, wherein said only one of said alert means consumes a least amount of power among said plurality of alert means.

10. A paging receiver according to claim 9, wherein said only one of said alert means is a light-emitting diode.

11. A method of controlling a paging receiver comprising the steps of:

receiving and demodulating radio signals conveying paging calls and detecting a paging call designating said paging receiver, driving a plurality of alert means to report an initial detection to a person carrying said paging receiver either for a duration of a first predetermined time period or until said plurality of alert means are manually stopped, and when a succeeding paging call is subsequently detected and the detection is stored while said plurality of alert means are being driven, driving said plurality alert means anew either for the duration of said first predetermined time period or until said plurality of alert means are manually stopped, and driving only one of said alert means for a second predetermined time period beginning with either the time when said first predetermined time elapses or the time when said plurality of alert means are manually stopped and ending with either the time when the duration of a second predetermined time period elapses or the time when said only one of said alert means is manually stopped.

12. A method of controlling a paging receiver according to claim 11, wherein said second predetermined time period depends on a number or prescribed time periods, each one of said prescribed time periods being assigned to each individual one of said succeeding paging calls and every detection of said succeeding paging calls being reported one by one in order either for the duration of the individually assigned time periods or until said only one of said alert means is manually stopped.

13. A method of controlling a paging receiver according to claim 12, wherein a part or the entirety of said first predetermined time period and each of said assigned time periods are equal.

14. A method of controlling a paging receiver according to claim 12, wherein a part or the whole of said first predetermined time period and each of said assigned time periods are equal.

15. A method of controlling a paging receiver according to claim 14, wherein said one alert means consumes the least power among said plurality of alert means.

16. A method of controlling a paging receiver according to claim 14, herein said one alert means is a light-emitting diode.

17. A method of controlling a paging receiver according to claim 12, wherein said one alert means consumes the least power among said plurality of alert means.

18. A method of controlling a paging receiver according to claim 17, wherein said one alert means is a light-emitting diode.

19. A method of controlling a paging receiver according to claims 11 or 12, wherein only one of said alert means consumes the least amount of power among said plurality of alert means.

20. A method of controlling a paging receiver according to claim 19, wherein said only one of said alert means is a light-emitting diode.

* * * * *